US006685289B2

(12) United States Patent
Anderson et al.

(10) Patent No.: US 6,685,289 B2
(45) Date of Patent: Feb. 3, 2004

(54) LOW VOLTAGE DIFFERENTIAL SIGNALING FOR COMMUNICATING WITH INKJET PRINTHEAD ASSEMBLY

(75) Inventors: Daryl E. Anderson, Corvallis, OR (US); Dennis J. Schloeman, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/158,971

(22) Filed: May 31, 2002

(65) Prior Publication Data

US 2002/0140747 A1 Oct. 3, 2002

Related U.S. Application Data

(63) Continuation of application No. 09/779,281, filed on Feb. 8, 2001.

(51) Int. Cl.[7] ..... B41J 2/07; B41J 29/38
(52) U.S. Cl. ..... 347/5
(58) Field of Search ..... 347/5, 9, 19

(56) References Cited

U.S. PATENT DOCUMENTS

| | | | | |
|---|---|---|---|---|
| 4,463,359 A | 7/1984 | Ayata et al. | 347/56 |
| 4,595,935 A | 6/1986 | Brooks et al. | 347/171 |
| 4,596,995 A | 6/1986 | Yamakawa et al. | 347/237 |
| 4,695,853 A | 9/1987 | Hackleman et al. | 347/62 |
| 4,695,854 A | 9/1987 | Cruz-Uribe | 347/40 |
| 4,719,477 A | 1/1988 | Hess | 347/59 |
| 4,764,659 A | 8/1988 | Minami et al. | 347/209 |
| 4,982,199 A | 1/1991 | Dunn | 347/15 |
| 4,989,224 A | 1/1991 | Narahara et al. | 377/39 |
| 4,999,650 A | 3/1991 | Braun | 347/58 |
| 5,016,023 A | 5/1991 | Chan et al. | 347/42 |

(List continued on next page.)

FOREIGN PATENT DOCUMENTS

| | | |
|---|---|---|
| EP | 0547921 A2 | 6/1993 |
| EP | 1031421A 1 | 8/2000 |
| JP | 07242004 | 3/1994 |
| JP | 08127140 | 10/1994 |

OTHER PUBLICATIONS

Huq, Syed, An Overview of LVDS Technology, National Semiconductor Application Note 971 [Online], Jul. 1998 [retrieved on Feb. 04, 2002]. Retrieved from the internet: <URL: http://www.national.com/an/AN/AN–971.pdf>.*

National Semiconductor, "Moving Info with LVDS, A General Design Guide for National's Low Voltage Differential Signaling (LVDS) and Bus LVDS Products,"LVDS Owner'Manual, XP–002232434, 2nd Edition, pp. 1–15, (Spring 2000). <www.national.com/appinfo/lvds/>.

A copy of European Search Report for Application No. EP 02 25 0458 mailed on Mar. 19, 2003 (3 pages).

Allen, Ross R., "Ink Jet Printing with Large Pagewide Arrays: Issues and Challenges," Recent Progress in Ink Jet Technologies II, Chapter 2, pp. 114–120.

*Primary Examiner*—Thinh Nguyen
*Assistant Examiner*—Julian D. Huffman

(57) ABSTRACT

An inkjet printing system includes an electronic controller including electronics providing first signals having first signaling levels, and low voltage differential signaling (LVDS) drivers which receive the first signals and convert the first signals to second signals having LVDS levels. Cabling is coupled to the LVDS drivers and carries the second signals to an inkjet printhead assembly. The inkjet printhead assembly includes LVDS receivers coupled to the cabling and receiving the second signals and converting the second signals to third signals having third signaling levels.

38 Claims, 5 Drawing Sheets

U.S. PATENT DOCUMENTS 5,030,971 A 7/1991 Drake et al. ..... 347/57
5,049,898 A 9/1991 Arthur et al. ..... 347/19
5,057,854 A 10/1991 Pond et al. ..... 347/42
5,079,189 A 1/1992 Drake et al. ..... 347/42
5,098,503 A 3/1992 Drake ..... 156/299
5,103,246 A 4/1992 Dunn ..... 347/58
5,160,945 A 11/1992 Drake ..... 347/42
5,327,165 A 7/1994 Elliott ..... 347/211
5,363,134 A 11/1994 Barbehenn et al. ..... 347/19
5,365,312 A 11/1994 Hillmann et al. ..... 399/12
5,371,530 A 12/1994 Hawkins et al. ..... 347/9
5,541,629 A 7/1996 Saunders et al. ..... 347/12
5,604,513 A 2/1997 Takahashi et al. ..... 345/589
5,610,635 A 3/1997 Murray et al. ..... 347/7
5,646,660 A 7/1997 Murray ..... 347/59
5,648,804 A 7/1997 Keefe et al. ..... 347/47
5,676,475 A 10/1997 Dull ..... 400/174
5,696,544 A 12/1997 Komuro ..... 347/50
5,699,091 A * 12/1997 Bullock et al. ..... 347/19
5,719,605 A 2/1998 Anderson et al. ..... 347/59
5,742,305 A 4/1998 Hackleman ..... 347/42
5,755,024 A 5/1998 Drake et al. ..... 29/890.1
5,801,721 A * 9/1998 Gandy et al. ..... 347/5
5,815,172 A 9/1998 Moh ..... 347/14
5,815,180 A 9/1998 Barbour et al. ..... 347/59
5,864,253 A 1/1999 Katakura et al.
5,867,183 A 2/1999 Cornell et al. ..... 347/13
5,886,718 A 3/1999 Johnson et al. ..... 347/85
5,946,012 A 8/1999 Courian et al. ..... 347/63
5,987,543 A * 11/1999 Smith ..... 710/70
6,002,420 A 12/1999 Tanioka et al. ..... 347/237
6,091,891 A 7/2000 Overall et al. ..... 378/98.2
6,109,716 A 8/2000 Takahashi ..... 347/11
6,126,261 A 10/2000 Yamanaka ..... 347/12
6,178,009 B1 1/2001 Yamada et al. ..... 358/1.9
6,193,345 B1 2/2001 Feinn et al. ..... 347/12
6,280,011 B1 8/2001 Schloeman et al. ..... 347/12
6,388,591 B1 * 5/2002 Ng ..... 710/71

* cited by examiner

LOW VOLTAGE DIFFERENTIAL SIGNALING FOR COMMUNICATING WITH INKJET PRINTHEAD ASSEMBLY

This is a Continuation of application Ser. No. 09/779,281 filed Feb. 8, 2001.

CROSS-REFERENCE TO RELATED APPLICATIONS

This Non-Provisional Patent Application is related to commonly-assigned U.S. Patent Application "MODULE MANAGER FOR WIDE-ARRAY INKJET PRINTHEAD ASSEMBLY" filed on Jan. 5, 2001, with Attorney Docket No. 10002118-1, which is herein incorporated by reference.

THE FIELD OF THE INVENTION

The present invention relates generally to inkjet printheads, and more particularly to communicating signals to an inkjet printhead assembly with low voltage differential signaling.

BACKGROUND OF THE INVENTION

A conventional inkjet printing system includes a printhead, an ink supply which supplies liquid ink to the printhead, and an electronic controller which controls the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

Typically, the printhead ejects the ink drops through the nozzles by rapidly heating a small volume of ink located in vaporization chambers with small electric heaters, such as thin film resisters. Heating the ink causes the ink to vaporize and be ejected from the nozzles. Typically, for one dot of ink, a remote printhead controller typically located as part of the processing electronics of a printer, controls activation of an electrical current from a power supply external to the printhead. The electrical current is passed through a selected thin film resister to heat the ink in a corresponding selected vaporization chamber.

Advanced printhead designs now permit an increased number of nozzles to be implemented on a single printhead. Moreover, in one arrangement, commonly referred to as a wide-array inkjet printing system, a plurality of individual printheads, also referred to as printhead dies, are mounted on a single carrier. In these arrangements, a number of nozzles and, therefore, an overall number of ink drops which can be ejected per second is increased. Since the overall number of drops which can be ejected per second is increased, printing speed can be increased with a wide-array inkjet printing system and/or printheads having an increased number of nozzles.

As the number of nozzles on a single carrier or a single printhead increases, the number of corresponding thin film resisters which need to be electrically coupled to the remote printhead controller correspondingly increases, which results in a correspondingly large number of conductive paths carrying nozzle data, fire signals, and other data signals to the printheads. Voltage switching in the large number of signals carried on the conductive paths generates undesirable electromagnetic interference (EMI). In addition, the ejection of ink from the nozzles (i.e., firing of the nozzles) requires a switching on and off of a large amount of electrical current in a short amount of time. The switching on and off of nozzle current of a large number of nozzles simultaneously generates undesirable EMI.

The EMI generated as a result of voltage switching in the signals carried on the conductive paths and nozzle firing causes conductive paths, such as cables, to conduct and/or radiate undesirable EMI. EMI is undesirable because EMI interferes with internal components of the printing system and can also interfere with other electric devices and appliances not associated with the printing system, such as computers, radios, and televisions. Moreover, systems, such as printing systems, typically need to comply to an electromagnetic compliance (EMC) standard which defines limits to levels of stray EMI noise signals. For example, EMC standards are set by government regulatory agencies, such as the Federal Communications Commission (FCC), which set electrical emission standards for electric devices.

For reasons stated above and for other reasons presented in greater detail in the Description of the Preferred Embodiment section of the present specification, an inkjet printing system is desired which minimizes the amount of undesirable EMI conducted and/or radiated by the conductive paths which communicate data signals from the electronic controller to the printhead(s).

SUMMARY OF THE INVENTION

One aspect of the present invention provides an inkjet printing system including an electronic controller and inkjet printhead assembly coupled together via cabling. The electronic controller includes electronics providing first signals having first signaling levels. The electronic controller also includes low voltage differential signaling (LVDS) drivers which receive the first signals and convert the first signals to second signals having LVDS levels. The cabling is coupled to the LVDS drivers and carries the second signals to the inkjet printhead assembly. The inkjet printhead assembly includes LVDS receivers coupled to the cabling and receiving the second signals and converting the second signals to third signals having third signaling levels.

One aspect of the present invention provides an electronic controller for an inkjet printing system. The electronic controller is adapted to couple to cabling. The cabling is coupled to an inkjet printhead assembly in the inkjet printing system. The electronic controller includes electronics which provide first signals having first signaling levels. The electronic controller includes LVDS drivers which receive the first signals, convert the first signals to second signals having LVDS levels, and provide the second signals to the cabling.

One aspect of the present invention provides a method of inkjet printing including providing first signals having first signaling levels in an electronic controller. The method includes converting the first signals to second signals having LVDS levels in the electronic controller. The method includes carrying the second signals to an inkjet printhead assembly. The method includes receiving the second signals in the inkjet printhead assembly. The method includes converting the second signals to third signals having third signaling levels in the inkjet printhead assembly.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. The inkjet printhead assembly and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
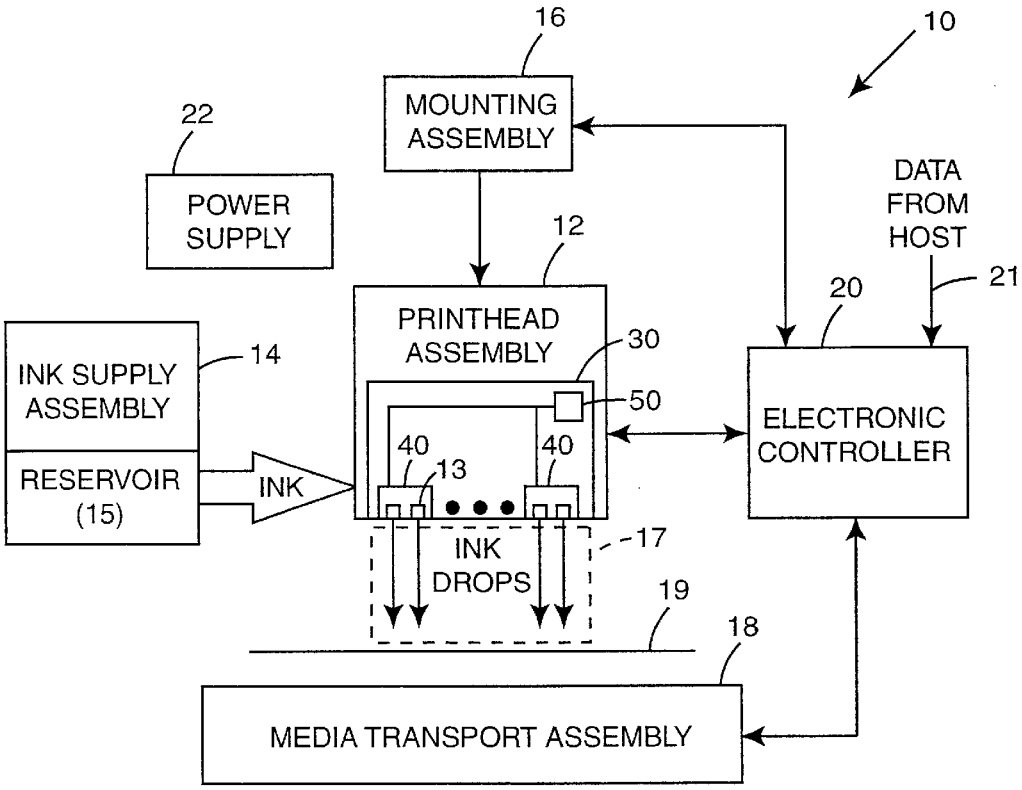
FIG. 1 is a block diagram illustrating one embodiment of an inkjet printing system.

FIG. 1 illustrates one embodiment of an inkjet printing system 10. Inkjet printing system 10 includes an inkjet printhead assembly 12, an ink supply assembly 14, a mounting assembly 16, a media transport assembly 18, and an electronic controller 20. At least one power supply 22 provides power to the various electrical components of inkjet printing system 10. Inkjet printhead assembly 12 includes at least one printhead or printhead die 40 which ejects drops of ink through a plurality of orifices or nozzles 13 and toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. Ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, only a portion of the ink supplied to printhead assembly 12 is consumed during printing. As such, ink not consumed during printing is returned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller or printer controller 20 typically includes a processor, firmware, and other printer electronics for communicating with and controlling inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical, or other information transfer path. Data 21 represents, for example, a document and/or file to be printed. As such, data 21 forms a print job for inkjet printing system 10 and includes one or more print job commands and/or command parameters.

In one embodiment, the at least one printhead 40 in inkjet assembly 12 is directly coupled to electronic controller 20. In this embodiment, electronic controller 20 controls inkjet printhead assembly 12 for ejection of ink drops from nozzles 13. As such, electronic controller 20 defines a pattern of ejected ink drops which form characters, symbols, and/or other graphics or images on print medium 19. The pattern of ejected ink drops is determined by the print job commands and/or command parameters.

In one embodiment, logic and drive circuitry are incorporated in a module manager integrated circuit (IC) 50 located on inkjet printhead assembly 12. Module manager IC 50 is similar to the module manager IC discussed in the above incorporated commonly-assigned patent application entitled "MODULE MANAGER FOR WIDE-ARRAY INKJET PRINTHEAD ASSEMBLY." In this embodiment, electronic controller 20 and module manager IC 50 operate together to control inkjet printhead assembly 12 for ejection of ink drops from nozzles 13. As such, electronic controller 20 and module manager IC 50 define a pattern of ejected ink drops which form characters, symbols, and/or other graphics or images on print medium 19. The pattern of ejected ink drops is determined by the print job commands and/or command parameters.

In one embodiment, inkjet printhead assembly 12 is a wide-array or multi-head printhead assembly. In one embodiment, inkjet printhead assembly 12 includes a carrier 30, which carries printhead dies 40 and module manager IC 50. In one embodiment carrier 30 provides electrical communication between printhead dies 40, module manager IC 50, and electronic controller 20, and fluidic communication between printhead dies 40 and ink supply assembly 14.

Figure 2:
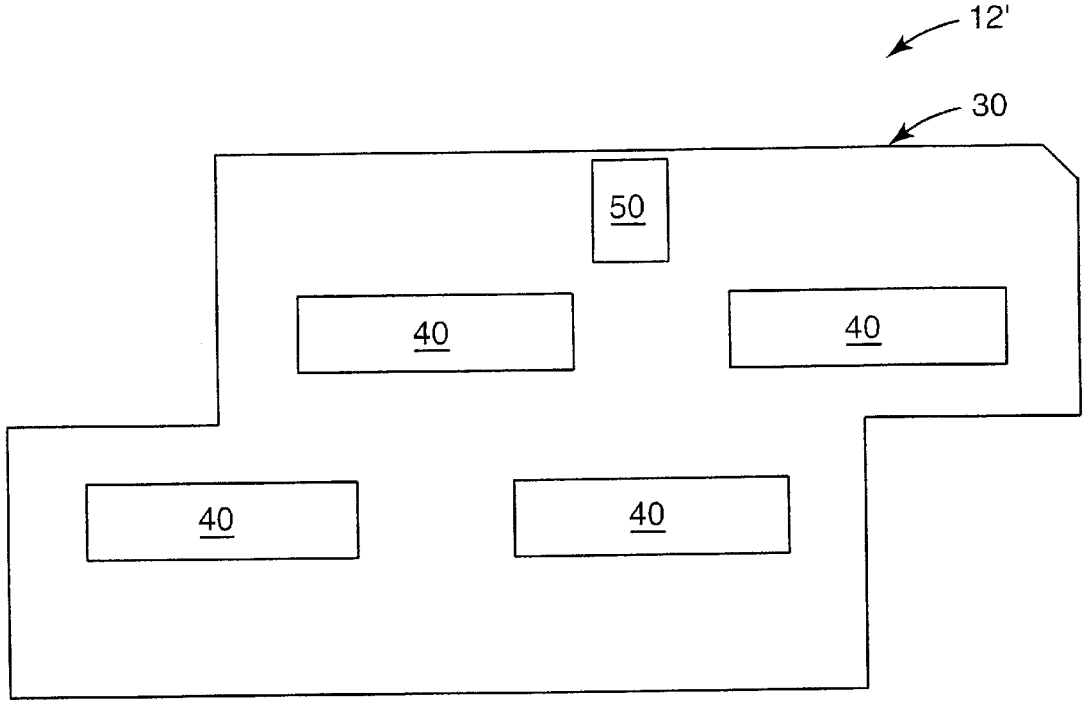
FIG. 2 is a diagram of one embodiment of an inkjet et printhead sub-assembly or module.

In one embodiment, printhead dies 40 are spaced apart and staggered such that printhead dies 40 in one row overlap at least one printhead die 40 in another row. Thus, inkjet printhead assembly 12 may span a nominal page width or a width shorter or longer than nominal page width. In one embodiment, a plurality of inkjet printhead sub-assemblies or modules 12' (illustrated in FIG. 2) form one inkjet printhead assembly 12. The inkjet printhead modules 12' are substantially similar to the above described printhead assembly 12 and each have a carrier 30 which carries a plurality of printhead dies 40 and a module manager IC 50. In one embodiment, the printhead assembly 12 is formed of multiple inkjet printhead modules 12' which are mounted in an end-to-end manner and each carrier 30 has a staggered or stair-step profile. As a result, at least one printhead die 40 of one inkjet printhead module 12' overlaps at least one printhead die 40 of an adjacent inkjet printhead module 12'.

Figure 3:
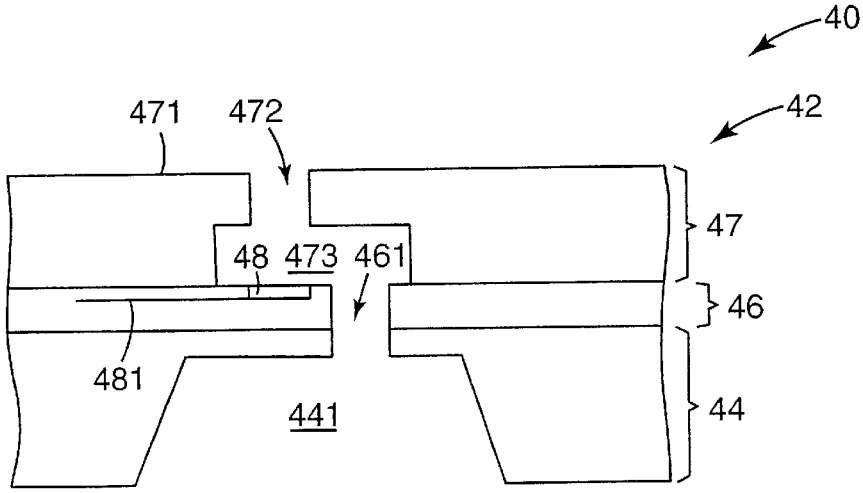
FIG. 3 is an enlarged schematic cross-sectional view illustrating portions of a one embodiment of a printhead die in the printing system of FIG. 1.

A portion of one embodiment of a printhead die 40 is illustrated schematically in FIG. 3. Printhead die 40 includes an array of printing or drop ejecting elements 42. Printing elements 42 are formed on a substrate 44 which has an ink feed slot 441 formed therein. As such, ink feed slot 441 provides a supply of liquid ink to printing elements 42. Each printing element 42 includes a thin-film structure 46, an orifice layer 47, and a firing resistor 48. Thin-film structure 46 has an ink feed channel 461 formed therein which communicates with ink feed slot 441 of substrate 44. Orifice layer 47 has a front face 471 and a nozzle opening 472 formed in front face 471. Orifice layer 47 also has a nozzle chamber 473 formed therein which communicates with nozzle opening 472 and ink feed channel 461 of thin-film structure 46. Firing resistor 48 is positioned within nozzle chamber 473 and includes leads 481 which electrically couple firing resistor 48 to a drive signal and ground.

During printing, ink flows from ink feed slot 441 to nozzle chamber 473 via ink feed channel 461. Nozzle opening 472 is operatively associated with firing resistor 48 such that droplets of ink within nozzle chamber 473 are ejected through nozzle opening 472 (e.g., normal to the plane of firing resistor 48) and toward a print medium upon energization of firing resistor 48.

Example embodiments of printhead dies 40 include a thermal printhead, a piezoelectric printhead, a flex-tensional printhead, or any other type of inkjet ejection device known in the art. In one embodiment, printhead dies 40 are fully integrated thermal inkjet printheads. As such, substrate 44 is formed, for example, of silicon, glass, or a stable polymer and thin-film structure 46 is formed by one or more passivation or insulation layers of silicon dioxide, silicon carbide, silicon nitride, tantalum, poly-silicon glass, or other suitable material. Thin-film structure 46 also includes a conductive layer which defines firing resistor 48 and leads 481. The conductive layer is formed, for example, by aluminum, gold, tantalum, tantalum-aluminum, or other metal or metal alloy.

Printhead assembly 12 can include any suitable number (N) of printheads 40, where N is at least one. Before a print operation can be performed, data must be sent to printhead 40 from electronic controller 20. Data includes, for example, print data and non-print data for printhead 40. Print data includes, for example, nozzle data containing pixel information, such as bitmap print data. Non-print data includes, for example, command/status (CS) data, clock data, and/or synchronization data. Status data of CS data includes, for example, printhead temperature or position, printhead resolution, and/or error notification. Example non-print data includes fire signals generated by electronic controller 20 remote from printhead 40 to control the timing and activation of an electrical current from power supply 22 to thereby control the ejection of ink drops from printhead 40. In one embodiment, printheads 40 receive fire signals containing fire pulses from electronic controller 20.

Figure 4:
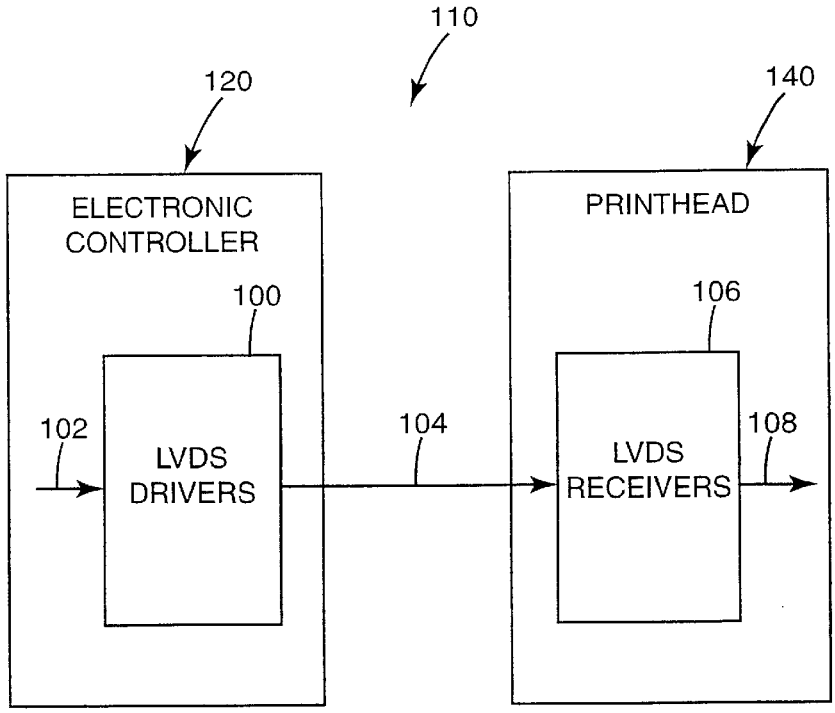
FIG. 4 is a block diagram illustrating one embodiment of an inkjet printing system according to the present invention which employs low voltage differential signaling (LVDS) to communicate data to a printhead.

One embodiment of an inkjet printing system according to the present invention is illustrated generally at 110 in FIG. 4. Inkjet printing system 110 includes an electronic controller 120 similar to electronic controller 20 of inkjet printing system 10. Inkjet printing system 110 also includes a printhead 140 similar to printhead 40 described above. Inkjet printing system 110 employs low voltage differential signaling (LVDS) to communicate data from electronic controller 120 to printhead 140. By contrast, conventional inkjet printing systems typically employ standard transistor-transistor logic (TTL) or complementary metal-oxide semiconductor (CMOS) signaling levels to communicate data to an inkjet printhead.

Electronic controller 120 includes LVDS drivers 100 which receive CMOS or TTL signaling level data on lines 102. Electronic controller 120 includes electronics which provide the CMOS or TTL signaling level data on lines 102. LVDS drivers 100 convert the CMOS or TTL signaling level data to LVDS levels. LVDS drivers 100 provide LVDS level data on cabling 104.

Cabling 104 carries the LVDS level data to LVDS receivers 106 in printhead 140. LVDS receivers 106 convert the LVDS level data carried on cabling 104 to CMOS or TTL signaling level data which is provided on lines 108. Lines 108 are coupled to printhead electronics which utilize the CMOS or TTL signaling level data.

The data communicated from electronic controller 120 to printhead 140 via LVDS on cabling 104 can be print data or non-print data. In one embodiment, signals, other than data, transmitted from electronic controller 120 to printhead 140 employ LVDS drivers 100 in electronic controller 120 and LVDS receivers 106 in printhead 140 to provide LVDS communication from electronic controller 120 to printhead 140.

The LVDS employed by inkjet printing system 110 to communicate data and possibly other signals from electronic controller 120 to printhead 140 over cabling 104 substantially reduces voltage swings in the signals carried on the cabling. LVDS, accordingly, substantially reduces the amount of electromagnetic interference (EMI) conducted and/or radiated by cabling 104, as compared to the EMI conducted and/or radiated by the cabling in conventional inkjet printing systems which carries data and other signals from the electronic controller to the printhead using standard CMOS or TTL signaling. Moreover, high-speed signal integrity of signals communicated via cabling 104 is increased with LVDS, as compared to standard CMOS or TTL signaling.

Figure 5:
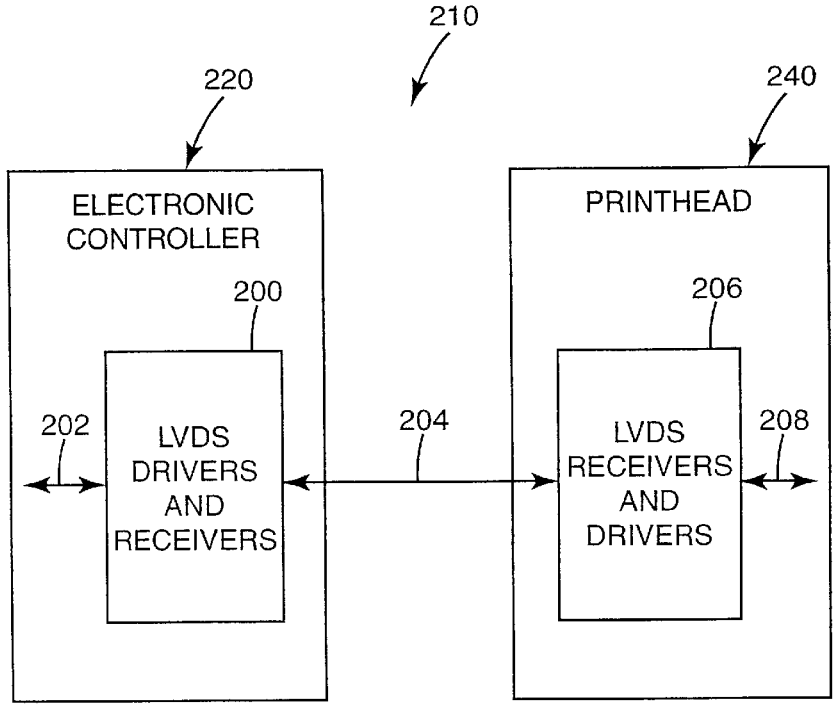
FIG. 5 is a block diagram illustrating one embodiment of an inkjet printing system according to the present invention employing LVDS to communicate data between an electronic controller and a printhead.

An alternative embodiment inkjet printing system according to the present invention is generally illustrated at 210 in FIG. 5. Inkjet printing system 210 includes an electronic controller 220 similar to electronic controller 120 of inkjet printing system 110. Electronic controller 220 communicates with a printhead 240 similar to printhead 140 of inkjet printing system 110. However, electronic controller 220 includes LVDS drivers and receivers 200 which communicate with lines 202. Lines 202 carry CMOS or TTL signaling level data. LVDS drivers and receivers 200 also communicate with cabling 204. Cabling 204 is coupled to and communicates with LVDS receivers and drivers 206 in printhead 240. LVDS receivers and drivers 206 are coupled to and communicate with lines 208. Lines 208 communicate CMOS or TTL signaling level data with electronics in printhead 240.

In one operation, the LVDS drivers and receivers 200 convert CMOS or TTL signaling level data on lines 202 to LVDS level data which is provided on cabling 204 to LVDS receivers and drivers 206 in printhead 240. The LVDS receivers and drivers 206 convert the LVDS data from cabling 204 to CMOS or TTL signaling level data provided on lines 208 to the electronics in printhead 240.

In another operation, LVDS receivers and drivers 206 convert CMOS or TTL signaling level data or signals provided from electronics in printhead 240 on lines 208 to LVDS level data or signals provided on cabling 204. Cabling 204 provides the LVDS level data or signals to LVDS drivers and receivers 200 in electronic controller 220. LVDS drivers and receivers 200 receive the LVDS level data or signals and convert the LVDS level data or signals to corresponding CMOS or TTL signaling level data or signals, which are provided on lines 202 to electronics in electronic controller 220.

For example, in one embodiment of inkjet printing system 210 illustrated in FIG. 5, status data read from printhead 240 is provided back to electronic controller 220 with LVDS. Therefore, any type of print data, non-print data, or other signaling can be communicated from electronic controller 220 to printhead 240 or from printhead 240 to electronic controller 220 employing LVDS on cabling 204. In this way, any data or signals communicated between electronic controller 220 and printhead 240 employing LVDS have substantially reduced voltage swings in cabling 204, as compared to CMOS or TTL signaling level voltage swings. The reduced voltage swings in cabling 204 correspondingly reduce the amount of EMI conducted and/or radiated by cabling 204, as compared to conventional cabling between an electronic controller and printhead using standard CMOS or TTL signaling.

Figure 6:
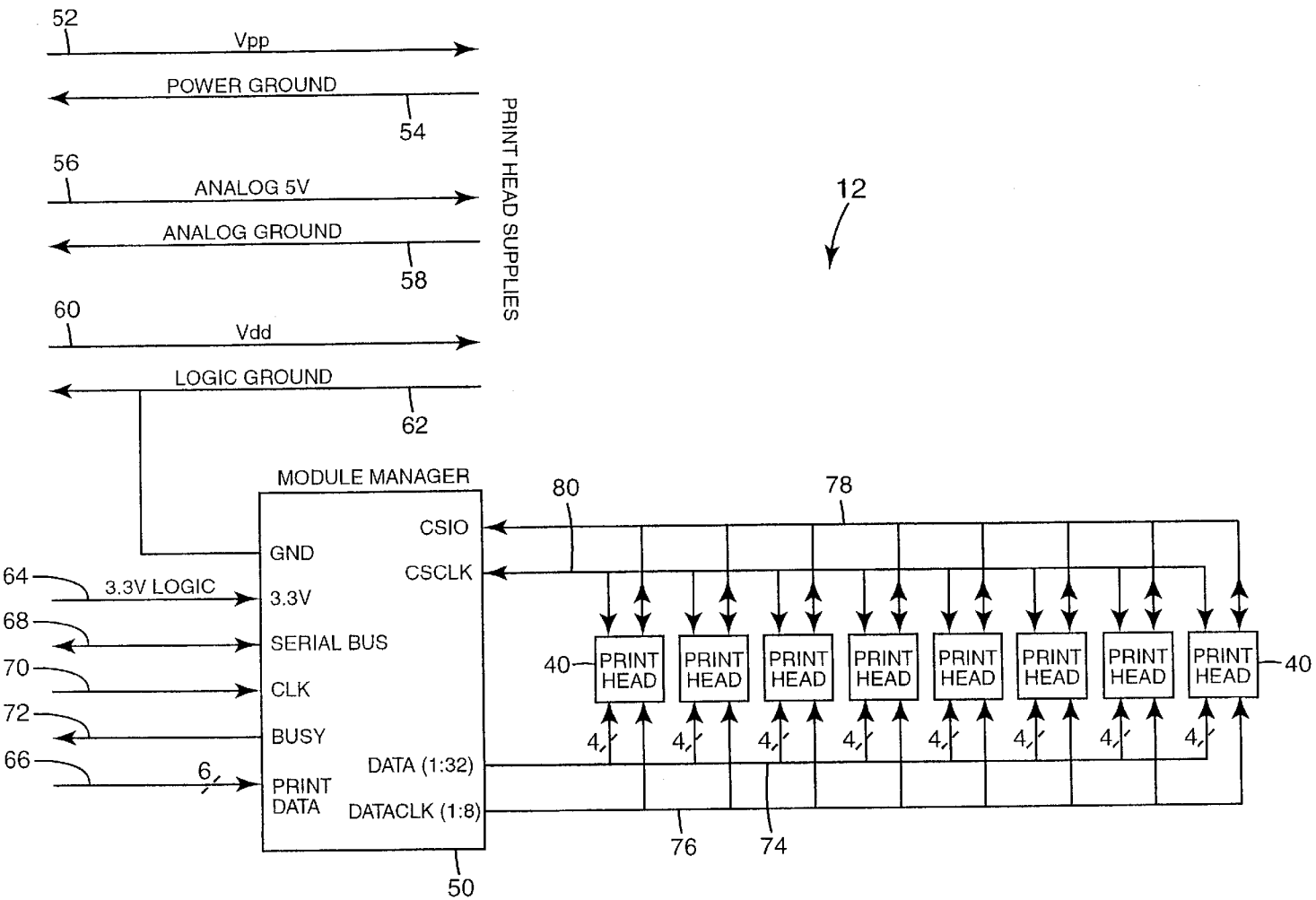
FIG. 6 is a block diagram illustrating a portion of an inkjet printhead assembly having a module manager integrated circuit (IC).

A portion of one embodiment of an inkjet printhead assembly 12 is illustrated generally in FIG. 6. Inkjet printhead assembly 12 includes complex analog and digital electronic components. Thus, inkjet printhead assembly 12 includes printhead power supplies for providing power to the electronic components within printhead assembly 12. For example, a Vpp power supply 52 and corresponding power ground 54 supply power to the firing resisters in printheads 40. An example 5-volt analog power supply 56 and corresponding analog ground 58 supply power to the analog electronic components in printhead assembly 12. An example 5-volt logic supply 60 and a corresponding logic ground 62 supply power to logic devices requiring a 5-volt logic power source. A 3.3-volt logic power supply 64 and the logic ground 62 supply power to logic components requiring a 3.3-volt logic power source, such as module manager 50. In one embodiment, module manager 50 is an application specific integrated circuit (ASIC) requiring a 3.3-volt logic power source.

In the example embodiment illustrated in FIG. 6, printhead assembly 12 includes eight printheads 40. Printhead assembly 12 can include any suitable number (N) of printheads. Before a print operation can be performed, data must be sent to printheads 40. Data includes, for example, print data and non-print data for printheads 40. Print data includes, for example, nozzle data containing pixel information, such as bitmap print data. Non-print data includes, for example, command/status (CS) data, clock data, and/or synchronization data. Status data of CS data includes, for example, printhead temperature or position, printhead resolution, and/or error notification.

Module manager IC 50 according to the present invention receives data from electronic controller 20 and provides both print data and non-print data to the printheads 40. For each printing operation, electronic controller sends nozzle data to module manager IC 50 on a print data line 66 in a serial format. The nozzle data provided on print data line 66 may be divided into two or more sections, such as even and odd nozzle data. In the example embodiment illustrated in FIG. 6, serial print data is received on print data line 66 which is 6 bits wide. The print data line 66 can be any suitable number of bits wide.

Independent of nozzle data, command data from electronic controller 20 may be provided to and status data read from printhead assembly 12 over a serial bi-directional non-print data serial bus 68.

A clock signal from electronic controller 20 is provided to module manager IC 50 on a clock line 70. A busy signal is provided from module manager IC 50 to electronic controller 20 on a line 72.

Module manager IC 50 receives the print data on line 66 and distributes the print data to the appropriate printhead 40 via data line 74. In the example embodiment illustrated in FIG. 6, data line 74 is 32 bits wide to provide four bits of serial data to each of the eight printheads 40. Data clock signals based on the input clock received on line 70 are provided on clock line 76 to clock the serial data from data line 74 into the printheads 40. In the example embodiment illustrated in FIG. 6, clock line 76 is eight bits wide to provide clock signals to each of the eight printheads 40.

Module manager IC 50 writes command data to and reads status data from printheads 40 over serial bi-directional CS data line 78. A CS clock is provided on CS clock line 80 to clock the CS data from CS data line 78 to printheads 40 and to module manager 50.

In the example embodiment of inkjet printhead assembly 12 illustrated in FIG. 6, the number of conductive paths in the print data interconnect between electronic controller 20 and inkjet printhead assembly 12 is significantly reduced, because an example module manager IC (e.g., ASIC) 50 is capable of much faster data rates than data rates provided by current printheads. For one example printhead design and example module manager ASIC 50 design, the print data interconnect is reduced from 32 pins to six lines to achieve the same printing speed, such as in the example embodiment of inkjet printhead assembly 12 illustrated in FIG. 6. This reduction in the number of conductive paths in the print data interconnect significantly reduces costs and improves reliability of the printhead assembly and the printing system.

In addition, module manager IC 50 can provide certain functions that can be shared across all the printheads 40. In this embodiment, the printhead 40 can be designed without certain functions, such as memory and/or processor intensive functions, which are instead performed in module manager IC 50. In addition, functions performed by module manager IC 50 are more easily updated during testing, prototyping, and later product revisions than functions performed in printheads 40.

Moreover, certain functions typically performed by electronic controller 20 can be incorporated into module manager IC 50. For example, one embodiment of module manager IC 50 monitors the relative status of the multiple printheads 40 disposed on carrier 30, and controls the printheads 40 relative to each other, which otherwise could only be monitored/controlled relative to each other off the carrier with the electronic controller 20.

In one embodiment, module manager IC 50 permits standalone printheads to operate in a multi-printhead printhead assembly 12 without modification. A standalone printhead is a printhead which is capable of being independently coupled directly to an electronic controller. One example embodiment of printhead assembly 12 includes standalone printheads 40 which are directly coupled to module manager IC 50.

Figure 7:
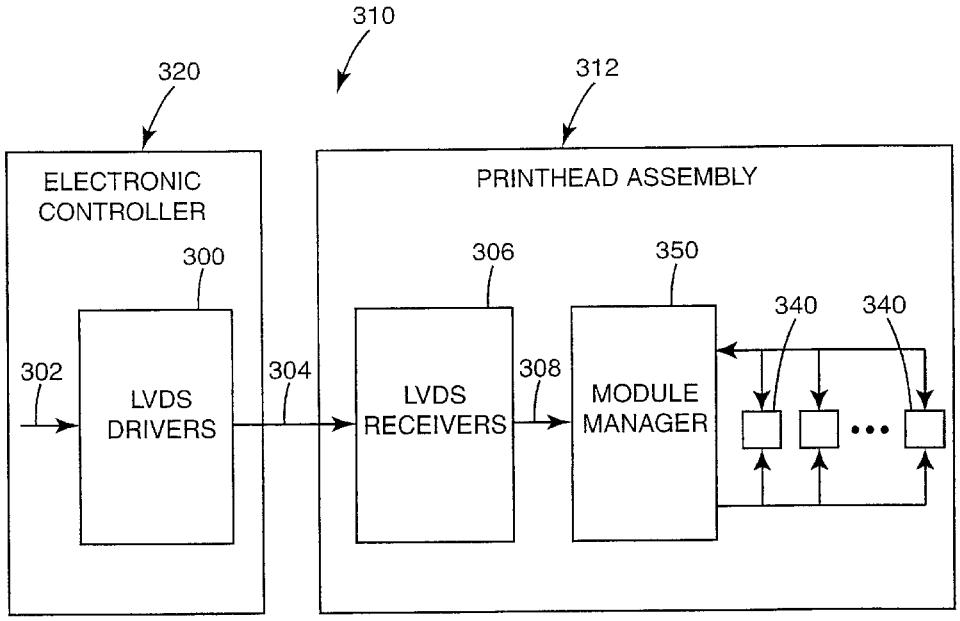
FIG. 7 is a block diagram illustrating an inkjet printing system according to the present invention employing LVDS to communicate data to a printhead assembly having a module manager IC.

One embodiment of an inkjet printing system according to the present invention which utilizes a module manager IC to communicate with multiple printheads is generally illustrated at 310 in FIG. 7. Inkjet printing system 310 includes electronic controller 320 which is similar to electronic controller 120 of inkjet printing system 110. Electronic controller 320 includes LVDS drivers 300 which receive CMOS or TTL signaling level data from lines 302. Electronic controller 320 includes electronics which provide the CMOS or TTL signaling level data on lines 302. LVDS drivers 300 convert the CMOS or TTL signaling level data to LVDS level data which is provided on cabling 304.

Inkjet printing system 310 includes printhead assembly 312. Printhead assembly 312 includes LVDS receivers 306 which are coupled to cabling 304. LVDS receivers 306 convert the LVDS level data received on cabling 304 to CMOS signaling level data provided on line 308 to module manager IC 350 of printhead assembly 312. Module manager IC 350 operates similar to module manager IC 50 described above in reference to FIG. 6 to communicate with multiple printheads 340, which are similar to the multiple printheads 40 described above in reference to FIG. 6.

The LVDS employed by inkjet printing system 310 to communicate data and possibly other signals from electronic controller 320 to printhead assembly 312 over cabling 304 substantially reduces voltage swings in the signals carried on the cabling. LVDS, accordingly, substantially reduces the amount of EMI conducted and/or radiated by cabling 304, as compared to the EMI conducted and/or radiated by the cabling in conventional inkjet printing systems which carries data and other signals from the electronic controller to the printhead assembly using standard CMOS or TTL signaling. Furthermore, high-speed signal integrity of the signals carried on cabling 304 is increased with LVDS, as compared to standard CMOS or TTL signaling.

Figure 8:
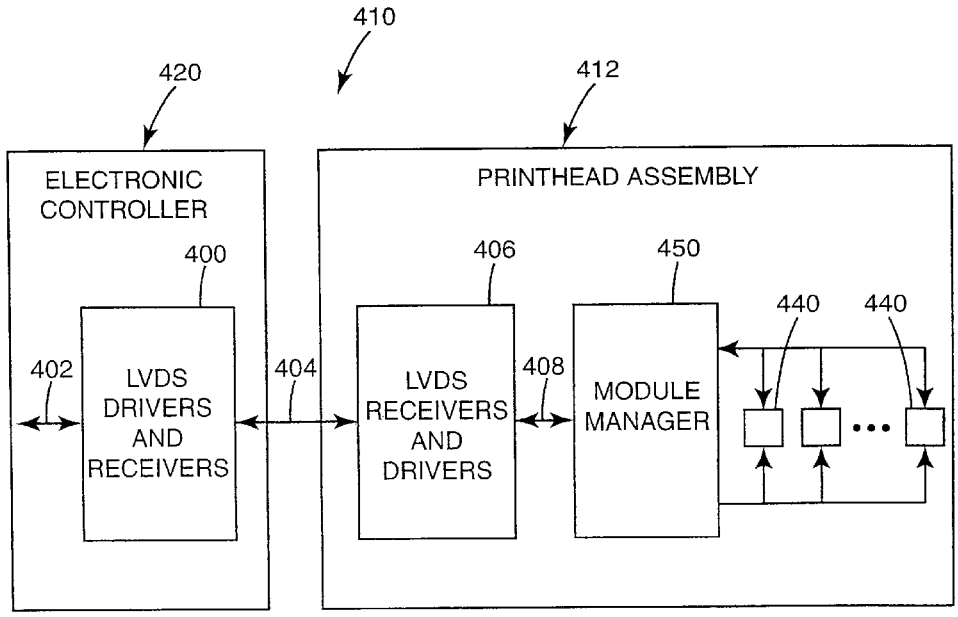
FIG. 8 is a block diagram of an inkjet printing system according to the present invention employing LVDS to communicate data between an electronic controller and a printhead assembly having a module manager IC.

An alternative embodiment of an inkjet printing system according to the present invention which utilizes a module manager IC to communicate with multiple printheads is generally illustrated at 410 in FIG. 8. Inkjet printing system 410 includes electronic controller 420 which is similar to electronic controller 220 of inkjet printing system 210. Electronic controller 420 includes LVDS drivers and receivers 400 which, in one operation, receive CMOS or TTL signaling level data from lines 402. Electronic controller 420 includes electronics which provide the CMOS or TTL signaling level data on lines 402. LVDS drivers and receivers 400 convert the CMOS or TTL signaling level data to LVDS level data which is provided on cabling 404.

Inkjet printing system 410 includes printhead assembly 412. Printhead assembly 412 includes LVDS receivers and drivers 406 which are coupled to cabling 404. In one operation, LVDS receivers and drivers 406 convert the LVDS level data received on cabling 404 to CMOS signaling level data provided on line 408 to module manager IC 450 of printhead assembly 412. Module manager IC 450 operates similar to module manager IC 50 described above in reference to FIG. 6 to communicate with multiple printheads 440, which are similar to the multiple printheads 40 described above in reference to FIG. 6.

In another operation, LVDS receivers and drivers 406 convert CMOS signaling level data or signals provided from module manager IC 450 on lines 408 to LVDS level data or signals provided on cabling 404. Cabling 404 provides the LVDS level data or signals to LVDS drivers and receivers 400 in electronic controller 420. LVDS drivers and receivers 400 receive the LVDS level data or signals and convert the LVDS level data or signals to corresponding CMOS or TTL signaling level data or signals, which are provided on lines 402 to electronics in electronic controller 420.

For example, in one embodiment of inkjet printing system 410 illustrated in FIG. 8, status data read from printheads 440 is provided back to module manager IC 450 and module manager IC 450 provides the status data as CMOS signaling level status data on lines 408. In this example, LVDS receivers and drivers 406 convert the status data from CMOS signaling level data to LVDS level data, which is provided from printhead assembly 412 to electronic controller 420 with LVDS on cabling 404. Therefore, any type of print data, non-print data, or other signaling can be communicated from electronic controller 420 to printhead assembly 412 or from printhead assembly 412 to electronic controller 420 employing LVDS on cabling 404. In this way, any data or signals communicated between electronic controller 420 and printhead assembly 412 employing LVDS have substantially reduced voltage swings in cabling 404, as compared to CMOS or TTL signaling level voltage swings. The reduced voltage swings in cabling 404 correspondingly reduce the amount of EMI conducted and/or radiated by cabling 404, as compared to conventional cabling between an electronic controller and printhead assembly using standard CMOS or TTL signaling.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An inkjet printing system comprising:

an electronic controller including:

electronics providing first signals having first signaling levels; and low voltage differential signaling (LVDS) drivers which receive the first signals and convert the first signals to second signals having LVDS levels; cabling coupled to the LVDS drivers and carrying the second signals; and an inkjet printhead assembly including:

LVDS receivers coupled to the cabling and receiving the second signals and converting the second signals to third signals having third signaling levels;

electronics providing fourth signals having the third signaling levels; and

LVDS drivers coupled to the cabling and receiving the fourth signals and converting the fourth signals to fifth signals having the LVDS levels.

2. The inkjet printing system of claim 1 wherein the first signaling levels comprise transistor-transistor logic (TTL) signaling levels.

3. The inkjet printing system of claim 1 wherein the first signaling levels comprise complementary metal-oxide semiconductor (CMOS) signaling levels.

4. The inkjet printing system of claim 1 wherein the third signaling levels comprise transistor-transistor logic (TTL) signaling levels.

5. The inkjet printing system of claim 1 wherein the third signaling levels comprise complementary metal-oxide semiconductor (CMOS) signaling levels.

6. The inkjet printing system of claim 1 wherein the third signaling levels are the same as the first signaling levels.

7. The inkjet printing system of claim 1 wherein the inkjet printhead assembly includes:

at least one printhead having the LVDS receivers.

8. The inkjet printing system of claim 1 wherein the inkjet printhead assembly includes:

a carrier;

N printheads disposed on the carrier; and a module manager disposed on the carrier and including the LVDS receivers and providing sixth signals to the N printheads based on the third signals.

9. The inkjet printing system of claim 1 wherein the electronic controller further includes:

LVDS receivers coupled to the cabling and receiving the fifth signals and converting the fifth signals to sixth signals having the first signaling levels which are provided to the electronics in the electronic controller.

10. An electronic controller for an inkjet printing system, the electronic controller adapted to couple to cabling, which is coupled to an inkjet printhead assembly in the inkjet printing system, the electronic controller comprising:

electronics providing first signals having first signaling levels;

low voltage differential signaling (LVDS) drivers which receive the first signals, convert the first signals to second signals having LVDS levels, and provide the second signals to the cabling; and LVDS receivers coupled to the cabling and receiving third signals having the LVDS levels from the printhead assembly over the cabling and converting the third signals to fourth signals having the first signaling levels which are provided to the electronics in the electronic controller.

11. The electronic controller of claim 10 wherein the first signaling levels comprise transistor-transistor logic (TTL) signaling levels.

12. The electronic controller of claim 10 wherein the first signaling levels comprise complementary metal-oxide semiconductor (CMOS) signaling levels.

13. The electronic controller of claim 10 wherein the first signaling levels are the same as selected signaling levels employed in the inkjet printhead assembly.

14. A method of inkjet printing comprising:

providing first signals having first signaling levels in an electronic controller;

converting the first signals to second signals having low voltage differential signaling (LVDS) levels in the electronic controller;

carrying the second signals to an inkjet printhead assembly;

receiving the second signals in the inkjet printhead assembly;

converting the second signals to third signals having third signaling levels in the inkjet printhead assembly;

providing fourth signals having the third signaling levels in the inkjet printhead assembly;

receiving the fourth signals in the inkiet Printhead assembly; and converting the fourth signals to fifth signals having the LVDS levels in the inkiet printhead assembly.

15. The method of claim 14 wherein the first signaling levels comprise transistor-transistor logic (17TTL) signaling levels.

16. The method of claim 14 wherein the first signaling levels comprise complementary metal-oxide semiconductor (CMOS) signaling levels.

17. The method of claim 14 wherein the third signaling levels comprise transistor-transistor logic (TTL) signaling levels.

18. The method of claim 14 wherein the third signaling levels comprise complementary metal-oxide semiconductor (CMOS) signaling levels.

19. The method of claim 14 wherein the third signaling levels are the same as the first signaling levels.

20. The method of claim 14 wherein the receiving the second signals and the converting the second signals steps are performed in at least one printhead.

21. The method of claim 14 wherein the inkjet printhead assembly includes a carrier, N printheads disposed on the carrier, and a module manager disposed on the carrier, and wherein the receiving the second signals and the converting the second signals steps are performed in the module manager.

22. The method of claim 21 wherein the method further comprises:

providing sixth signals from the module manager to the N printheads based on the third signals.

23. The method of claim 14 wherein further comprising:

carrying the fifth signals to the electronic controller;

receiving the fifth signals in the electronic controller; and converting the fifth signals to sixth signals having the first signaling levels in the electronic controller.

24. An inkjet printing system comprising:

an inkjet printhead assembly including:

electronics providing first signals having first signaling levels; and low voltage differential signaling (LVDS) drivers which receive the first signals and convert the first signals to second signals having LVDS levels; cabling coupled to the LVDS drivers and carrying the second signals; and an electronic controller including:

LVDS receivers coupled to the cabling and receiving the second signals and converting the second signals to third signals having third signaling levels.

25. The inkjet printing system of claim 24 wherein the first signaling levels comprise transistor-transistor logic (TTL) signaling levels.

26. The inkjet printing system of claim 24 wherein the first signaling levels comprise complementary metal-oxide semiconductor (CMOS) signaling levels.

27. The inkjet printing system of claim 24 wherein the third signaling levels comprise transistor-transistor logic (TTL) signaling levels.

28. The inkjet printing system of claim 24 wherein the third signaling levels comprise complementary metal-oxide semiconductor (CMOS) signaling levels.

29. The inkjet printing system of claim 24 wherein the third signaling levels are the same as the first signaling levels.

30. The inkjet printing system of claim 24 wherein the inkjet printhead assembly includes:

at least one printhead having the LVDS drivers.

31. The inkjet printing system of claim 24 wherein the inkjet printhead assembly includes:

a carrier;

N printheads disposed on the carrier; and a module manager disposed on the carrier and including the LVDS drivers and providing fourth signals to the N printheads based on the third signals.

32. The inkjet printing system of claim 24 wherein the electronic controller further includes:

electronics providing fourth signals having the third signaling levels; and

LVDS drivers coupled to the cabling and receiving the fourth signals and converting the fourth signals to fifth signals having the LVDS levels.

33. The inkjet printing system of claim 32 wherein the inkjet printhead assembly further includes:

LVDS receivers coupled to the cabling and receiving the fifth signals and converting the fifth signals to sixth signals having the first signaling levels which are provided to the electronics in the inkjet printhead assembly.

34. An electronic controller for an inkjet printing system, the electronic controller adapted to couple to cabling, which is coupled to an inkjet printhead assembly in the inkjet printing system, the electronic controller comprising:

low voltage differential signaling (LVDS) receivers adapted to couple to the cabling, to receive first signals having LVDS levels, and to convert the first signals to second signals having second signaling levels; and electronics adapted to receive the second signals.

35. The electronic controller of claim 34 wherein the second signaling levels comprise transistor-transistor logic (TTL) signaling levels.

36. The electronic controller of claim 34 wherein the second signaling levels comprise complementary metal-oxide semiconductor (CMOS) signaling levels.

37. The electronic controller of claim 34 further comprising:

electronics providing third signals having the second signaling levels; and

LVDS drivers coupled to the cabling and receiving the third signals and converting the third signals to fourth signals having the LVDS levels.

38. The electronic controller of claim 34 wherein the second signaling levels are the same as selected signaling levels employed in the inkjet printhead assembly.

* * * * *